US006363671B1

(12) United States Patent
O'Mara

(10) Patent No.: US 6,363,671 B1
(45) Date of Patent: Apr. 2, 2002

(54) TENSIONED FLOOR ASSEMBLY

(76) Inventor: Edward O'Mara, 3130 Eugene St., Burton, MI (US) 48519

( * ) Notice: Subject to any disclaimer, the term of this patent is extended or adjusted under 35 U.S.C. 154(b) by 0 days.

(21) Appl. No.: 09/457,459

(22) Filed: Dec. 8, 1999

(51) Int. Cl.[7] ..... E04C 3/12

(52) U.S. Cl. ..... 52/223.7; 52/480; 52/582.2; 52/582.1

(58) Field of Search ..... 52/223.7, 480, 52/582.2, 582.1, 262, 506.06

(56) References Cited

U.S. PATENT DOCUMENTS

| | | | | |
|---|---|---|---|---|
| 1,160,155 A | | 11/1915 | Eldred | |
| 1,573,724 A | | 2/1926 | Lowe et al. | |
| 2,102,086 A | * | 12/1937 | Mueller | 52/582.2 X |
| 2,266,464 A | * | 12/1941 | Kraft | 52/582.2 X |
| 2,776,471 A | | 1/1957 | Dobell | |
| 2,836,862 A | | 6/1958 | Jones | |
| 3,045,294 A | | 7/1962 | Livezey, Jr. | |
| 4,648,592 A | * | 3/1987 | Harinishi | 52/223.7 X |
| 6,032,427 A | * | 3/2000 | Randjelovic | 52/480 X |

* cited by examiner

*Primary Examiner*—Carl D. Friedman
*Assistant Examiner*—Phi Dieu Tran A
(74) *Attorney, Agent, or Firm*—Howard & Howard

(57) ABSTRACT

A floor assembly (10) including a plurality of rectangular panels (12) disposed in end-to-end relationship in adjacent rows with the panels (12) of one row overlapping the panels (12) of the next adjacent row, the panels being in abutting edge to edge relationship. A groove (18) is disposed in each of the abutting edges and a dowel strip (20) is adhesively secured in one of the grooves (18) of the abutting edges of adjacent panels (12). A discrete and resilient block (22) extends downwardly from the bottom surface (16) of the corner of each panel (12) to engage a support surface. A plurality of hooks (26) engage the outer peripheral edges of the peripheral panels (12). Each of the hooks (26) includes a tubular element (36) secured to the bottom surface (16) and a cable (38) and a tensioning device (40) places the cable (38) in tension between the elements (36) of first and second hooks (26).

19 Claims, 2 Drawing Sheets

TENSIONED FLOOR ASSEMBLY

BACKGROUND OF THE INVENTION

1. Field of the Invention

The subject invention relates to a tensioned floor assembly of the type which is portable and/or laid in floor elements which are held together by a tensioning means.

2. Description of the Prior Art

A wide variety of tensioned floor assemblies of the type to which the subject invention pertains are well known, particularly those which are portable by assembly and disassembly for movement between venues. Such assemblies typically include a plurality of floor panels each having four peripheral edges with a top surface and a bottom surface extending between the peripheral edges, a plurality of tensioning stringers for extending over the bottom surface and between opposing ones of the edges to hold the panels in edge to edge abutting relationship, and a plurality of supports extending downwardly from the bottom surfaces of the panels to support surfaces for supporting the panels on concrete, or the like. Examples of such assemblies are shown in U.S. Pat. No. 1,160,155 to Elred; U.S. Pat. No. 1,573,724 to Lowe et al: U.S. Pat. No. 2,776,471 to Dobell; U.S. Pat. No. 2,36,862 to Jones and U.S. Pat. No. 3,045,294 to Livezey.

Most of the prior assemblies comprise a large number of components which are especially manufactured for use only in a specific floor assembly. Often the tensioning system is complicated and/or unsightly. Of course, it is of prime importance that such floor assemblies be of a minimum number of components, easy and fast to assemble and disassemble, not unsightly and fabricated of inexpensive components, preferably fabricated from off- the-shelf elements which are easily modified to fabricate the components.

SUMMARY OF THE INVENTION AND ADVANTAGES

A tensioned floor assembly comprising a plurality of floor panels each having four peripheral edges with a top surface and a bottom surface extending between the peripheral edges, a plurality of tensioning stringers for extending over the bottom surface and between opposing ones of the edges to hold the panels in edge to edge abutting relationship, and a plurality of supports extending downwardly from the bottom surfaces of the panels to support surfaces for supporting the panels. The assembly is characterized by the stringers including hooks for engaging the edges and the top surfaces of selected ones of the panels.

This combination provides a tensioned floor assembly of a minimum number of components, easy and fast to assemble and disassemble, not unsightly and fabricated of inexpensive and off-the-shelf elements which are easily modified to fabricate the components. The hooks are of simple design and are easily placed between the peripheral edges of the aligned panels to hold the panels in alignment by the stringers running immediately adjacent the bottom surface of the panels.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Referring to the Figures, wherein like numerals indicate like or corresponding parts throughout the several views, a tensioned floor assembly is generally shown at 10.

Figure 1:
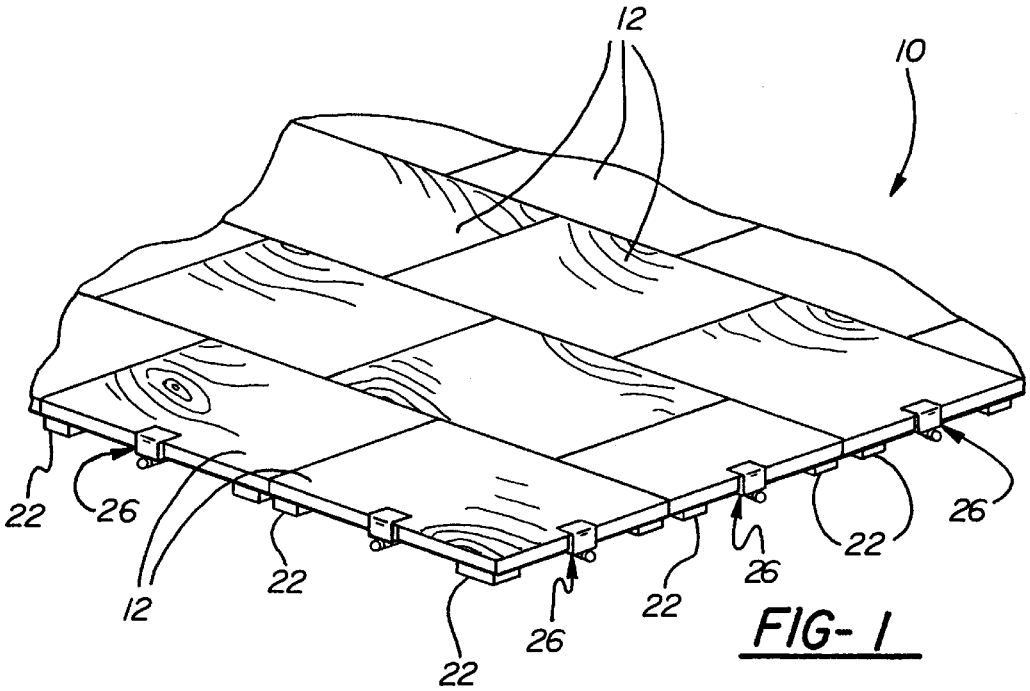
FIG. 1 is a fragmentary perspective view of the subject invention.
Figure 2:
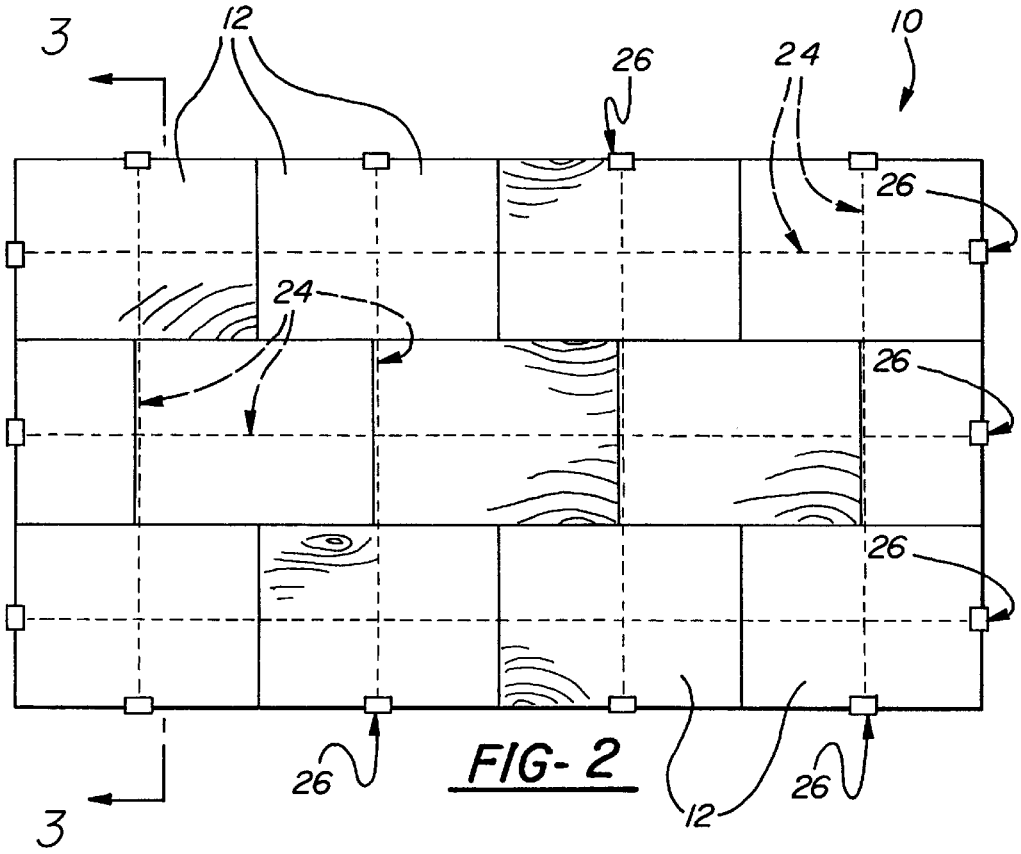
FIG. 2 is a plan view of the subject invention.
Figure 3:
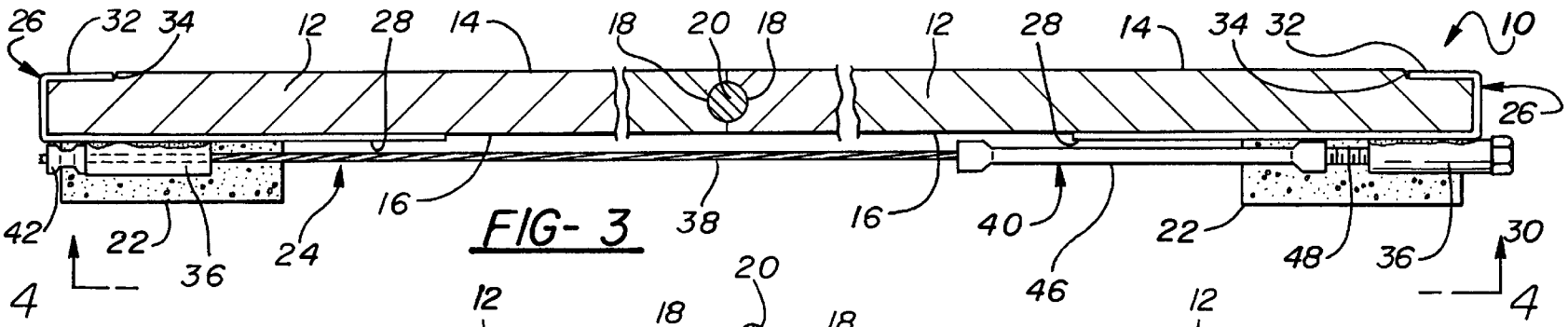
FIG. 3 is an enlarged fragmentary view taken along line 3—3 of FIG. 2.

The assembly 10 comprises a plurality of rectangular floor panels 12 each having four peripheral edges and, as shown in FIG. 3, with a top surface 14 and a bottom surface 16 extending between the peripheral edges. Each of the panels 12 consists of a sheet of plywood and are disposed in edge to edge abutting relationship with one another. The panels 12 are rectangular and disposed in end-to-end relationship in adjacent rows with the panels 12 of one row overlapping the panels 12 of the next adjacent row.

The abutting ones of the edges of the panels 12 include tongue and groove connections for guiding for aligning the top surfaces 14 of the panels 12. More specifically, the tongue and groove connections comprise grooves 18 in each of the abutting edges and a dowel strip 20 adhesively secured or mechanically fastened in one of the grooves 18 of the abutting edges of adjacent panels 12 to engage the other groove of the abutting edges of adjacent panels 12.

A plurality of supports comprising discrete blocks 22 extend downwardly from the bottom surfaces 16 of the panels 12 to support surfaces, i.e., s floor, for supporting the panels 12 on a floor. The blocks 22 are disposed at the corners of the respective panels 12 so as to be spaced from one another over the bottom surface 16 of each of the panels 12 to define spaces between the blocks. The blocks consist of a resilient material for absorbing vibrational forces.

A plurality of tensioning stringers, each generally indicated at 24, extend over the bottom surface 16 and between opposing ones of the edges to hold the panels 12 in edge to edge abutting relationship. The assembly 10 is characterized by the stringers 24 including metal hooks, each generally indicated at 26, for engaging the edges and the top surfaces 14 of selected ones or, as shown, all of the panels 12. The stringers 24 extend in the spaces between the blocks and above the support surfaces of the blocks.

Figure 4:
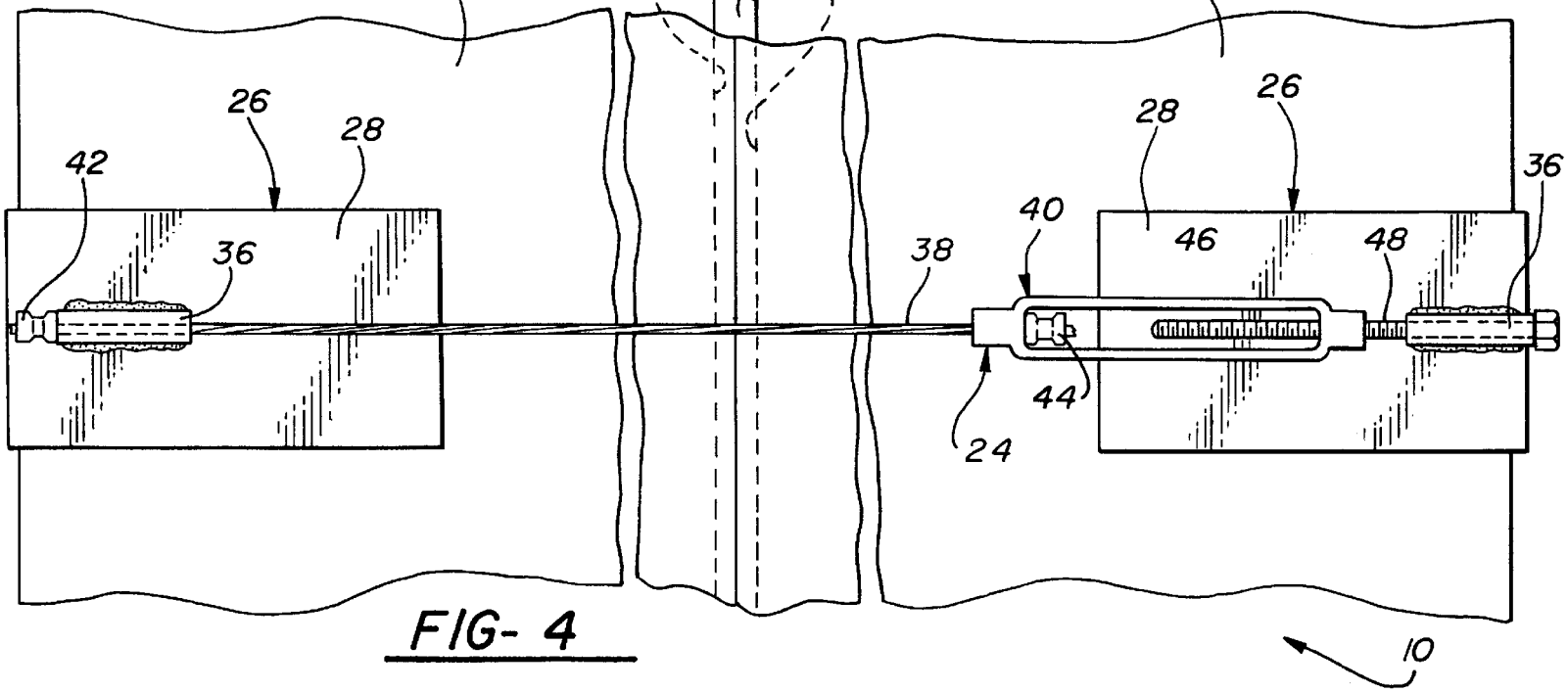
FIG. 4 is a bottom view taken along line 4—4 of FIG. 3.

As shown in FIGS. 3 and 4, each of the hooks 26 includes a flat bottom plate 28 for engaging the bottom surface 16 of one of the panels 12, an end plate 30 for engaging one of the edges, and a top plate 32 for engaging the top surface 14 of each of the periphery panels 12. In other words, some of the panels 12 define peripheral panels 12 for establishing outer peripheral edges of a floor and the end plates 30 of the hooks 26 engage the outer peripheral edges of these peripheral panels 12. In order to facilitate this engagement, the outer peripheral edges of the peripheral panels 12 include recesses 34 for receiving the top plates 32 of the hooks 26.

Each of the hooks 26 includes a tubular element 36 defining an anchor secured (e.g., welded) to the bottom surface 16 of the first and second hooks 26. Each of the stringers 24 includes a cable 38 and a tensioning device, generally indicated at 40, for placing the cable 38 in tension between the anchors 36 of first (left as shown) and second (right as shown) of the hooks 26. Each cable 38 extends through the anchor 36 on the bottom surface 16 of the first hook 26 and includes a first slug 42 secured to a first end of the cable 38 for engaging the tubular anchor 36 and a second slug 44 secured to a second end of the cable 38 for engaging the tensioning device 40.

The tensioning device 40 comprises a turnbuckle 46 and a screw 48 extending through the anchor 36 on the bottom surface 16 of the second hook 26 whereby the cable 38 is placed in tension between the first and second hooks 26 in response to rotation of the turnbuckle 46.

The invention has been described in an illustrative manner, and it is to be understood that the terminology which has been used is intended to be in the nature of words of description rather than of limitation.

Obviously, many modifications and variations of the present invention are possible in light of the above teachings and the invention may be practiced otherwise than as specifically described within the scope of the appended claims, wherein that which is prior art is antecedent to the novelty set forth in the ▯characterized by▯ clause. The novelty is meant to be particularly and distinctly recited in the ▯characterized by▯ clause whereas the antecedent recitations merely set forth an old and well known combination in which the invention resides and these antecedent recitations should be interpreted to cover any combination in which the inventive novelty has utility. In addition, the reference numerals are merely for convenience and are not to be in any way to be read as limiting.

What is claimed is:

1. A tensioned floor assembly comprising;

a plurality of floor panels (12) each having four peripheral edges with a top surface (14) and a bottom surface (16) extending between said peripheral edges, said panels including peripheral panels establishing outer peripheral edges including recesses (12) in said top surfaces (14) thereof adjacent said peripheral edges, a plurality of tensioning stringers (24) extending over said bottom surface (16) and between opposing ones of said edges to hold said panels (12) in edge to edge abutting relationship, and a plurality of supports (22) extending downwardly from said bottom surfaces (16) of said panels (12) to bottom support surfaces supporting said panels (12), said stringers (24) including hooks (26) for engaging said peripheral edges and said recesses in said top surfaces (14) of said peripheral panels (12).

2. An assembly as set forth in claim 1 wherein said supports (22) include a plurality of discrete blocks spaced from one another over said bottom surface (16) of each of said panels (12) to define spaces between said blocks.

3. An assembly as set forth in claim 2 wherein said stringers (24) extend in the spaces between said blocks and above said bottom support surfaces of said blocks.

4. An assembly as set forth in claim 3 wherein said blocks consist of a resilient material for absorbing vibrational forces.

5. An assembly as set forth in claim 4 wherein abutting ones of said edges of said panels (12) include tongue and groove connections for guiding and for aligning said top surfaces (14) of said panels (12).

6. An assembly as set forth in claim 5 wherein said tongue and groove connections comprise grooves (18) in each of said abutting edges and a dowel strip (20) secured in one of said grooves (18) of said abutting edges of adjacent panels (12) to engage the other groove of said abutting edges of adjacent panels (12).

7. An assembly as set forth in claim 1 wherein each of said hooks (26) includes a flat bottom plate (28) engaging said bottom surface (16) of one of said panels (12), an end plate (30) engaging one of said edges, and a top plate (32) for engaging said recess in said top surface (14) of said one of said peripheral panels (12).

8. An assembly as set forth in claim 1 wherein said panels (12) include peripheral panels (12) establishing outer peripheral edges of a floor, said end plates (30) of said hooks (26) engage said outer peripheral edges of said peripheral panels (12), said outer peripheral edges of said peripheral panels (12) include recesses (34) receiving said top plates (32) of said hooks (26).

9. An assembly as set forth in claim 7 wherein each of said hooks (26) includes an anchor and each of said stringers (24) include a cable (38) and tensioning device (40) placing said cable (38) in tension between said anchors of first and second of said hooks (26).

10. An assembly as set forth in claim 9 wherein said anchors consist of a tubular element (36) secured to said bottom surface (16) of said first and second hooks (26).

11. An assembly as set forth in claim 10 wherein said cable (38) extends through said anchor on said bottom surface (16) of said first hook (26) and includes a first slug (42) secured to a first end of said cable (38) engaging said tubular anchor and a second slug (44) secured to a second end of said cable (38) for engaging said tensioning device (40).

12. A tensioned floor assembly comprising;

a plurality of floor panels (12) each having four peripheral edges with a top surface (14) and a bottom surface (16) extending between said peripheral edges, a plurality of tensioning stringers (24) extending over said bottoms surface (16) and between opposing ones of said edges to hold said panels (12) in edge to edge abutting relationship, and a plurality of supports (22) extending downwardly from said bottom surfaces (16) of said panels (12) to bottom support surfaces supporting said panels (12), said stringers (24) including hooks (26) engaging said edges and said top surfaces (14) of selected ones of said panels (12), each of said hooks (26) including a flat bottom plate (28) engaging said bottom surface (16) and one of said panels (12), an end plate (30) engaging one of said edges, and a top plate (32) engaging said top surface (14) of said one of said panels (12);

each of said hooks (26) including an anchor and each of said stringers (24) including a cable (38) and tensioning device (40) placing said cable (38) in tension between said anchors of first and second of said hooks (26);

said anchors consisting of a tubular element (36) secured to said bottom surface (16) of said first and second hooks (26);

said cable (38) extending through said anchor on said bottom surface (16) of said first hook (26) and including a first slug (42) secured to a first end of said cable (38) engaging said tubular anchor and a second slug (44) secured to a second end of said cable (38) engaging said tensioning device (40), said tensioning device (40) comprising a turnbuckle (46) and a screw (48) extending through said anchor on said bottom surface (16) of said second hook (26) whereby said cable (38) is placed in tension between said first and second hooks (26) in response to rotation of said turnbuckle (46).

13. An assembly as set forth in claim 12 wherein each of said panels (12) consists of a sheet of plywood.

14. An assembly as set forth in claim 13 wherein abutting ones of said edges of said panels (12) include tongue and groove connections for guiding and for aligning said top surfaces (14) of said panels (12).

15. An assembly as set forth in claim 14 wherein said tongue and groove connections comprise grooves (18) in each of said abutting edges and a dowel strip (20) secured in one of said grooves (18) of said abutting edges of adjacent panels (12) to engage the other groove of said abutting edges of adjacent panels (12).

16. An assembly as set forth in claim 15 wherein said supports (22) include a plurality of discrete blocks spaced from one another over said bottom surface (16) of each of said panels (12) to define spaces between said blocks.

17. An assembly as set forth in claim 16 wherein said cables (38) extend in the spaces between said blocks.

18. An assembly as set forth in claim 17 wherein said blocks consist of a resilient material for absorbing vibrational forces.

19. An assembly as set forth in claim 18 wherein said panels (12) are rectangular and disposed in end-to-end relationship in adjacent rows with the panels (12) of one row overlapping the panels (12) of the next adjacent row.

* * * * *